US005639050A

United States Patent [19]

Peterson et al.

[11] Patent Number: 5,639,050

[45] Date of Patent: Jun. 17, 1997

[54] FOOD STORAGE BAG HOLDER

[76] Inventors: Wilma Peterson; Gary Peterson, both of 12 Patricia Rd., Middletown, N.Y. 10940

[21] Appl. No.: 630,940

[22] Filed: Apr. 5, 1996

[51] Int. Cl.[6] ..... A63B 55/04

[52] U.S. Cl. ..... 248/97; 220/404; 248/101; 248/316.7; 248/316.8

[58] Field of Search ..... 248/97, 99, 101, 248/316.4, 316.7, 316.8; 220/404, 401

[56] References Cited

U.S. PATENT DOCUMENTS

| | | | |
|---|---|---|---|
| 630,684 | 8/1899 | Goldsmith | 248/97 |
| 1,132,181 | 3/1915 | Hawke | 248/101 |
| 1,194,680 | 8/1916 | Studebaker | 220/404 X |
| 2,639,110 | 5/1953 | Nicolas | 248/97 X |
| 3,226,070 | 12/1965 | Kurlander | 248/97 |
| 4,322,048 | 3/1982 | Vollman | 248/97 |
| 4,750,638 | 6/1988 | Sosower | 220/404 |
| 4,867,328 | 9/1989 | McCarthy | 220/404 X |
| 5,380,081 | 1/1995 | Vogt | 248/97 X |

*Primary Examiner*—Leslie A. Braun
*Assistant Examiner*—Stephen S. Wentsler

[57] ABSTRACT

A food storage bag holder for supporting a food storage bag in an open position. The inventive device includes a pair of support members which can be positioned at a desired spacing by a pair of adjustable spacing means extending therebetween. Mounting clips are secured to upper edges of the support members to secure a food storage bag between the support members in an open position to facilitate loading of food or other objects into the storage bag. The spacing means extend along only one vertical side of the device to allow for lateral removal of a loaded food storage bag from the device.

10 Claims, 3 Drawing Sheets

FOOD STORAGE BAG HOLDER

BACKGROUND OF THE INVENTION

1. Field of the Invention

The present invention relates to holding devices and more particularly pertains to a food storage bag holder for supporting a food storage bag in an open position.

2. Description of the Prior Art

The use of holding devices is known in the prior art. More specifically, holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art holding devices include U.S. Pat. No. 5,303,889; U.S. Pat. No. 5,360,189; U.S. Pat. Des. No. 341,236; U.S. Pat. No. 5,222,704; U.S. Pat. No. 5,163,645; and U.S. Pat. No. 5,054,724.

While these devices fulfill their respective, particular objectives and requirements, the aforementioned patents do not disclose a food storage bag holder for supporting a food storage bag in an open position which includes a pair of support members which can be positioned at a desired spacing by a pair of adjustable spacing means extending therebetween; and mounting clips secured to upper edges of the support members to secure a food storage bag between the support members in an open position to facilitate loading of food or other objects into the storage bag, wherein the spacing means extend along only one vertical side of the device to allow for lateral removal of a loaded food storage bag from the device.

In these respects, the food storage bag holder according to the present invention substantially departs from the conventional concepts and designs of the prior art, and in so doing provides an apparatus primarily developed for the purpose of supporting a food storage bag in an open position.

SUMMARY OF THE INVENTION

In view of the foregoing disadvantages inherent in the known types of holding devices now present in the prior art, the present invention provides a new food storage bag holder construction wherein the same can be utilized for supporting a food storage bag in an open position. As such, the general purpose of the present invention, which will be described subsequently in greater detail, is to provide a new food storage bag holder apparatus and method which has many of the advantages of the holding devices mentioned heretofore and many novel features that result in a food storage bag holder which is not anticipated, rendered obvious, suggested, or even implied by any of the prior art holding devices, either alone or in any combination thereof.

To attain this, the present invention generally comprises a food storage bag holder for supporting a food storage bag in an open position. The inventive device includes a pair of support members which can be positioned at a desired spacing by a pair of adjustable spacing means extending therebetween. Mounting clips are secured to upper edges of the support members to secure a food storage bag between the support members in an open position to facilitate loading of food or other objects into the storage bag. The spacing means extend along only one vertical side of the device to allow for lateral removal of a loaded food storage bag from the device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new food storage bag holder apparatus and method which has many of the advantages of the holding devices mentioned heretofore and many novel features that result in a food storage bag holder which is not anticipated, rendered obvious, suggested, or even implied by any of the prior art holding devices, either alone or in any combination thereof.

It is another object of the present invention to provide a new food storage bag holder which may be easily and efficiently manufactured and marketed.

It is a further object of the present invention to provide a new food storage bag holder which is of a durable and reliable construction.

An even further object of the present invention is to provide a new food storage bag holder which is susceptible of a low cost of manufacture with regard to both materials and labor, and which accordingly is then susceptible of low prices of sale to the consuming public, thereby making such food storage bag holders economically available to the buying public.

Still yet another object of the present invention is to provide a new food storage bag holder which provides in the apparatuses and methods of the prior art some of the advantages thereof, while simultaneously overcoming some of the disadvantages normally associated therewith.

Still another object of the present invention is to provide a new food storage bag holder for supporting a food storage bag in an open position.

Yet another object of the present invention is to provide a new food storage bag holder for supporting a food storage bag in an open position which includes a pair of support members which can be positioned at a desired spacing by a pair of adjustable spacing means extending therebetween; and mounting clips secured to upper edges of the support members to secure a food storage bag between the support members in an open position to facilitate loading of food or other objects into the storage bag, wherein the spacing means extend along only one vertical side of the device to allow for lateral removal of a loaded food storage bag from the device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
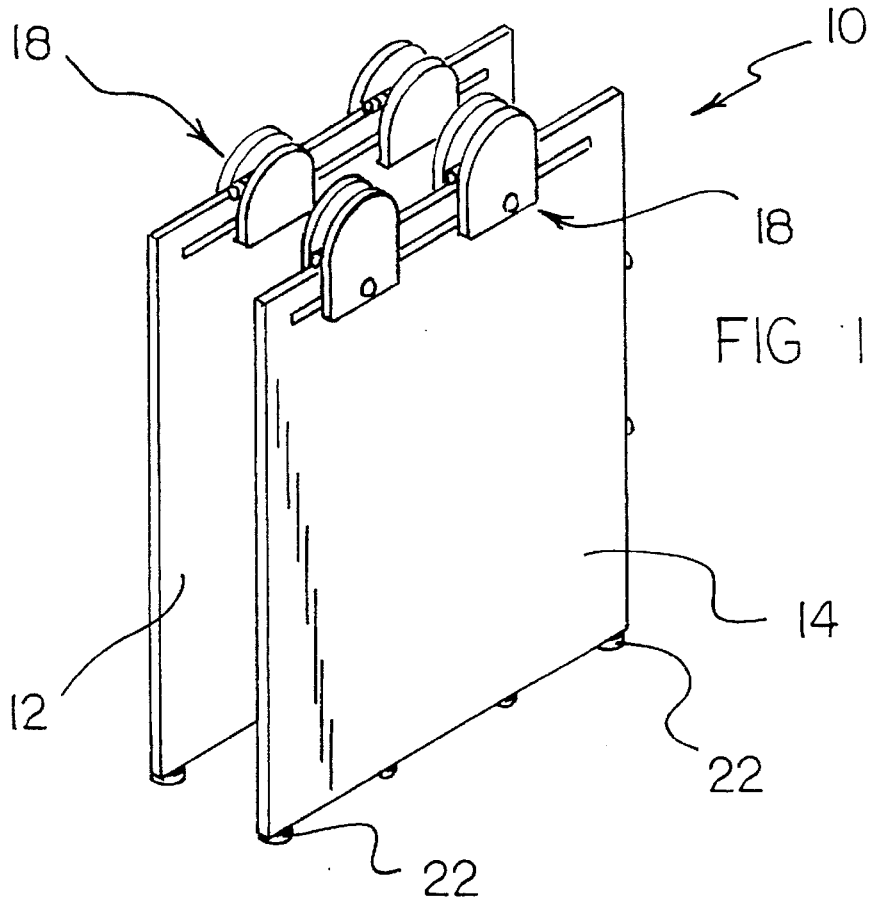
FIG. 1 is a first perspective illustration of the preferred embodiment of the food storage bag holder constructed in accordance with the principles of the present invention.
Figure 2:
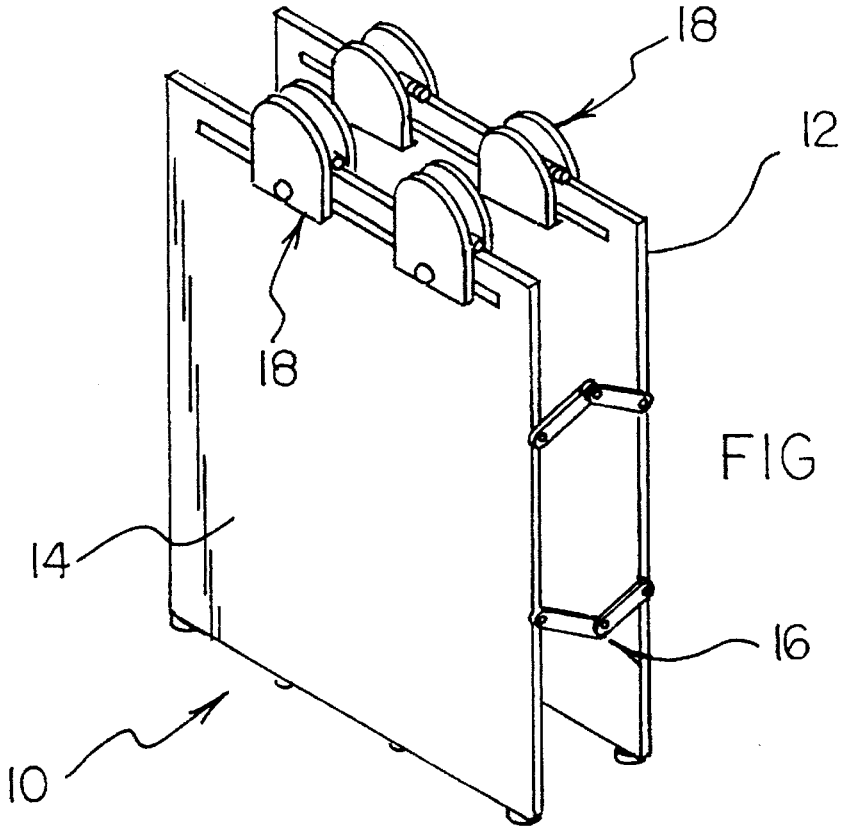
FIG. 2 is a second perspective illustration of the present invention.

With reference now to the drawings, and in particular to FIGS. 1–6 thereof, a new food storage bag holder embodying the principles and concepts of the present invention and generally designated by the reference numeral 10 will be described.

Figure 3:
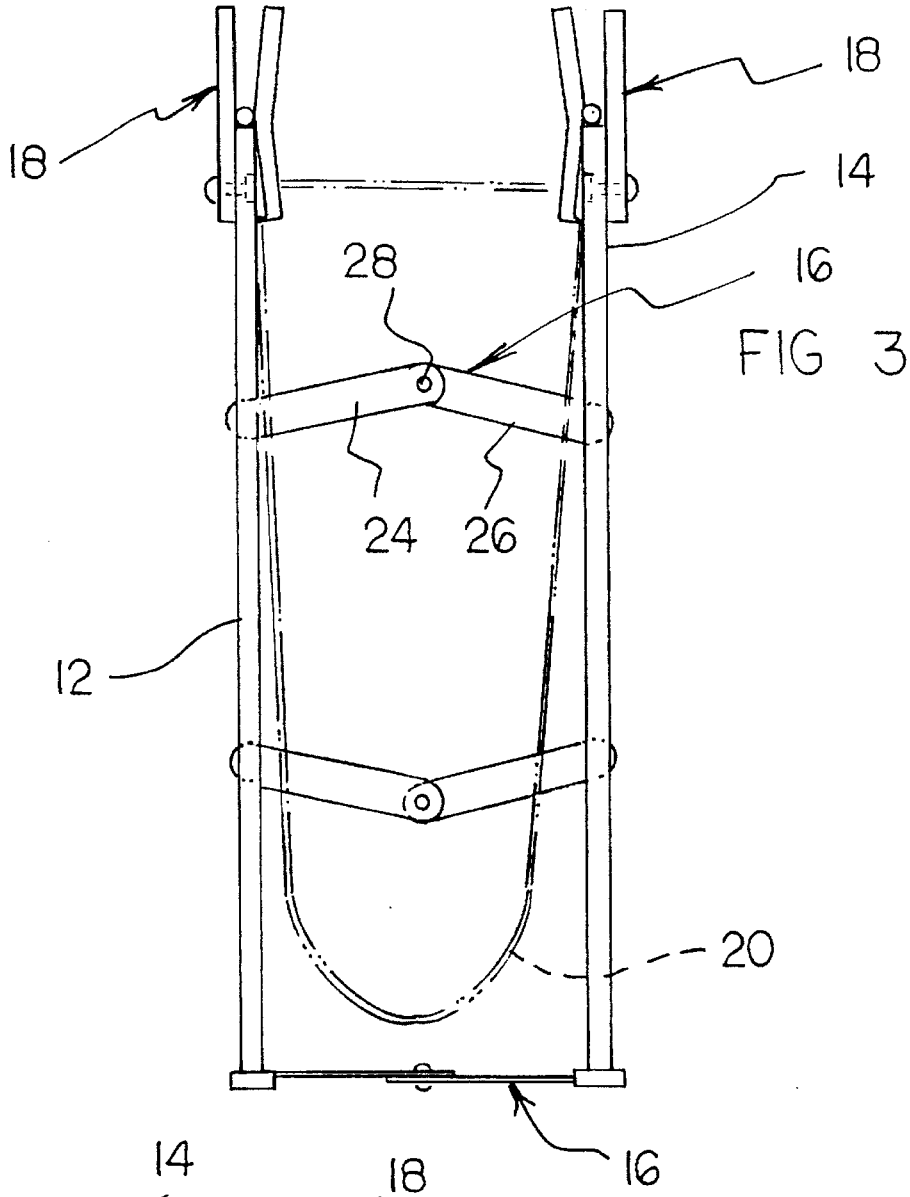
FIG. 3 is a side elevational view of the invention.

More specifically, it will be noted that the food storage bag holder 10 comprises a first support member 12 and a second support member 14 which may be comprised of planar members such as is illustrated in the drawings. Adjustable spacing means 16 are mounted to the support members 12 and 14 and extend therebetween to support the members in a spaced orientation. Mounting clips 18 are secured proximate to upper edges of the support members 12 and 14 and operate to engage the open upper edge of a food storage bag 20, such as is illustrated in FIG. 3, such that food can be loaded into the bag with ease. Resilient feet 22 made of rubber or a like material are secured to the lower edges of the support members 12 and 14 to prevent sliding of the invention 10 along a wet or damp countertop. By this structure, food can be easily loaded into an open food storage bag as desired.

Figure 4:
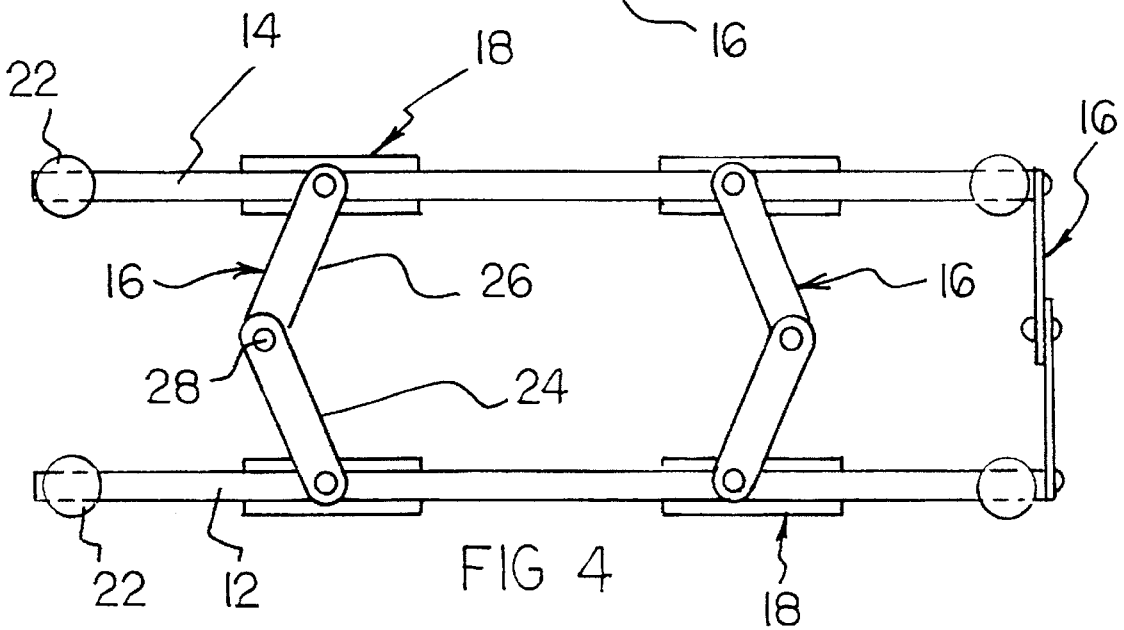
FIG. 4 s a bottom plan view of the invention.

Each of the adjustable spacing means 16, as shown in FIGS. 3 and 4, preferably comprises a first pivot arm 24 which is pivotally mounted by a pin or like hinge proximate to an outer peripheral edge of the first support member 12. Similarly, a second pivot arm 26 is pivotally mounted proximate to an outer peripheral edge of the second support member 14. The arms 24 and 26 are pivotally mounted together by a pivot pin 28. Preferably, the pivot pin 28 frictionally engages with both the arms 24 and 26 so as to frictionally retain the arms in a desired angular orientation such that once the support members 12 and 14 are positioned into a desired spacing and angle relative to one another, such spacing will be retained by the adjustable spacing means 16.

Figure 5:
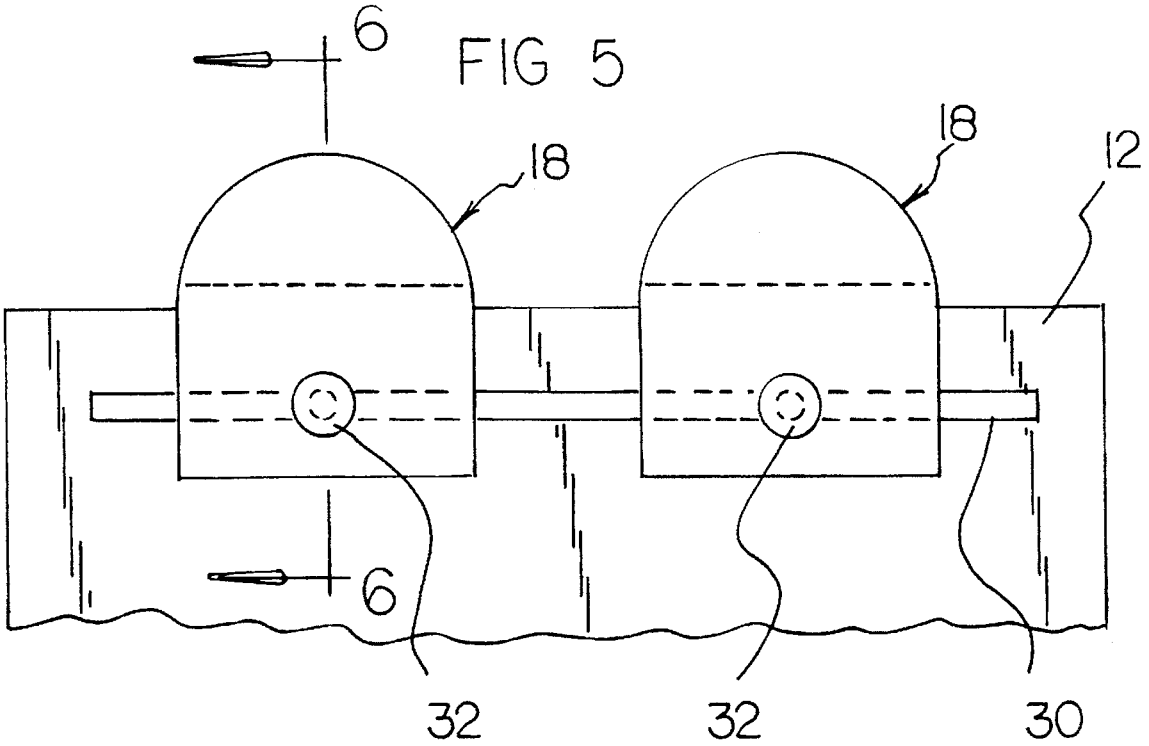
FIG. 5 is an enlarged side elevational view of a portion of the invention.
Figure 6:
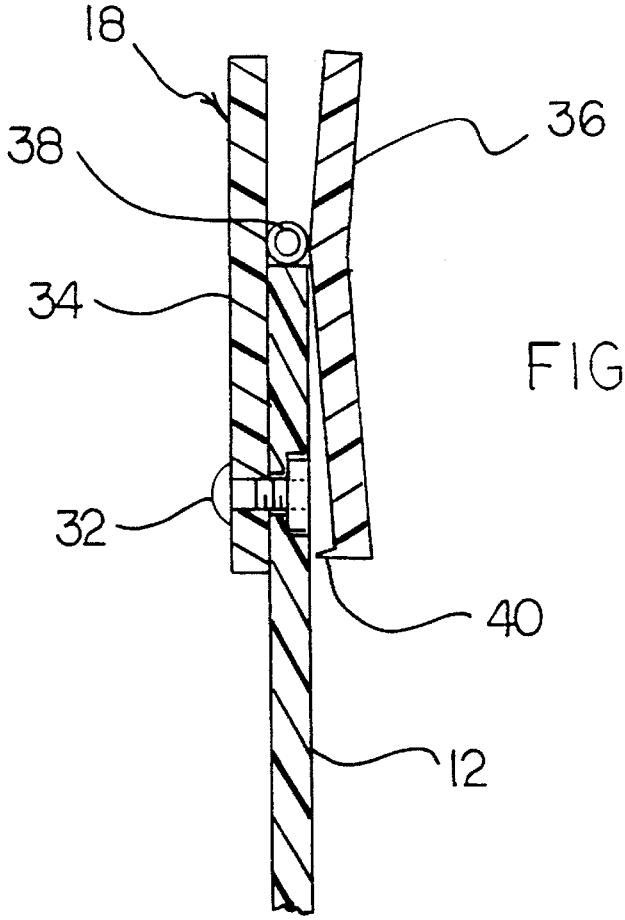
FIG. 6 is a cross sectional view taken along line 6—6 of FIG. 5.

Turning now to FIGS. 5 and 6, it can be shown that the mounting clips 18 are each slidably mounted to an upper end of the respective support member 12 or 14. To this end, the support members 12 and 14 each preferably comprises a planar member which is substantially rectangular in shape. The planar members are each shaped so as to define an elongated slot 30 extending parallel to the upper edge of the respective support member 12 or 14. The mounting clips 18 are each slidably mounted within this elongated slot 30 by a mounting pin 32 extending therethrough. More specifically, the mounting clips 18 each comprise a first clamp arm 34 through which the mounting pin 32 is directed. The mounting pin 32 extends into the slot 30 and is secured from removal therefrom by an unlabeled fastener which allows the mounting pin to slide within the slot 30. A second clamp arm 36 is pivotally mounted relative to the first clamp arm 34 by a spring hinge 38 which may be a torsion spring fastened to the clamp arms. The second clamp arm 36 includes gripping teeth 40 which capture a portion of the food storage bag 20 when placed within the invention 10. By this structure, the mounting clips 18 can be adjustably positioned to the outer extremities of an open food storage bag 20 to support the same within the invention 10 as shown in FIG. 3.

In use, the food storage bag holder 10 of the present invention 10 can be easily utilized for supporting a food storage bag in an open position. To this end, one simply places the bag between the support members and fastens the mounting clips 18 to the open upper end of the bag. Objects such as food or the like can then be easily loaded into the bag for subsequent storage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A food storage bag holder comprising:

a first support member;

a second support member;

adjustable spacing means mounted to the support members and extending therebetween for supporting the members in a spaced orientation, the adjustable spacing means comprises a first pivot arm pivotally mounted to the first support member; a second pivot arm pivotally mounted to the second support member; and a pivot pin pivotally mounting the arms together, the pivot pin frictionally engages with both arms so as to frictionally retain the arms in a desired angular orientation, the adjustable spacing means are mounted to the support members along only one vertical edge thereof so as to allow for lateral removal of a food storage bag from between the support members;

mounting clips secured proximate to upper edges of the support members for engaging an open upper edge of the food storage bag to support the bag between the support members.

2. The food storage bag holder of claim 1, wherein the mounting clips are each slidably mounted to an upper end of a respective one of the support members.

3. The food storage bag holder of claim 2, wherein the support members each comprise a planar member, the planar member being shaped so as to define an elongated slot extending parallel to the upper edge of the respective support member, with the mounting clips each being slidably mounted within the elongated slot by a mounting pin coupled to the mounting clip and extending into the slot.

4. The food storage bag holder of claim 3, wherein the mounting clips each comprise a first clamp arm through which the mounting pin is directed; a second clamp arm pivotally mounted relative to the first clamp arm by a spring hinge.

5. The food storage bag holder of claim 4, wherein the second clamp arm of each of the mounting clips includes gripping teeth which operate to capture a portion of the food storage bag.

6. A food storage bag holder comprising:

a food storage bag;

a first support member;

a second support member;

adjustable spacing means mounted to the support members and extending therebetween for supporting the members in a spaced orientation, the adjustable spacing means comprises each a first pivot arm pivotally mounted to the first support member; a second pivot arm pivotally mounted to the second support member; and a pivot pin pivotally mounting the arms together, the pivot pin frictionally engages with both arms so as to frictionally retain the arms in a desired angular orientation, the adjustable spacing means are mounted to the support members along only one vertical edge thereof so as to allow for lateral removal of the food storage bag from between the support members;

mounting clips secured proximate to upper edges of the support members for engaging an open upper edge of the food storage bag to support the bag between the support members.

7. The food storage bag holder of claim 6, wherein the mounting clips are each slidably mounted to an upper end of a respective one of the support members.

8. The food storage bag holder of claim 7, wherein the support members each comprise a planar member, the planar member being shaped so as to define an elongated slot extending parallel to the upper edge of the respective support member, with the mounting clips each being slidably mounted within this elongated slot by a mounting pin coupled to the mounting clip and extending into the slot.

9. The food storage bag holder of claim 8, wherein the mounting clips each comprise a first clamp arm through which the mounting pin is directed; a second clamp arm pivotally mounted relative to the first clamp arm by a spring hinge.

10. The food storage bag holder of claim 9, wherein the second clamp arm of each of the mounting clips includes gripping teeth which operate to capture a portion of the food storage bag.

* * * * *